US008529035B2

(12) United States Patent
Tsukamoto et al.

(10) Patent No.: US 8,529,035 B2
(45) Date of Patent: Sep. 10, 2013

(54) INK JET CARTRIDGE AND MANUFACTURING METHOD OF INK JET CARTRIDGE

(75) Inventors: Naoya Tsukamoto, Kawasaki (JP); Hiroyuki Yamamoto, Kawasaki (JP); Jun Hinami, Kawasaki (JP); Takeshi Shibata, Yokohama (JP); Hirotaka Miyazaki, Yokohama (JP); Yoshiaki Kurihara, Kawasaki (JP); Ryo Shimamura, Yokohama (JP); Tomohiro Takahashi, Yokohama (JP); Tatsunori Fujii, Kawasaki (JP); Masashi Ishikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 177 days.

(21) Appl. No.: 13/017,688

(22) Filed: Jan. 31, 2011

(65) Prior Publication Data

US 2011/0211028 A1 Sep. 1, 2011

(30) Foreign Application Priority Data

Feb. 26, 2010 (JP) ..... 2010-041734

(51) Int. Cl.
*B41J 2/175* (2006.01)

(52) U.S. Cl.
USPC ..... 347/86

(58) Field of Classification Search
None
See application file for complete search history.

(56) References Cited

U.S. PATENT DOCUMENTS

| | | | | |
|---|---|---|---|---|
| 5,852,457 | A | 12/1998 | Kotaki et al. | 347/86 |
| 5,980,031 | A | 11/1999 | Sasaki et al. | 347/85 |
| 6,234,618 | B1 | 5/2001 | Yamamoto et al. | 347/86 |
| 6,270,206 | B1 | 8/2001 | Shimizu et al. | 347/86 |
| 6,334,674 | B1 | 1/2002 | Ono et al. | 347/86 |
| 6,485,136 | B1 | 11/2002 | Shimizu et al. | 347/86 |
| 6,652,949 | B2 | 11/2003 | Iwanaga et al. | 428/65.9 |
| 6,698,871 | B1 | 3/2004 | Hayashi et al. | 347/86 |
| 6,698,872 | B2 * | 3/2004 | Hou et al. | 347/86 |
| 6,815,381 | B1 | 11/2004 | Yamamoto et al. | 442/187 |
| 2002/0051043 | A1 * | 5/2002 | Hsu et al. | 347/86 |

FOREIGN PATENT DOCUMENTS

| | | |
|---|---|---|
| EP | 756935 | 2/1997 |
| EP | 894630 | 2/1999 |
| JP | 6-255121 | 9/1994 |
| JP | 7-047688 | 2/1995 |
| JP | 9-183236 | 7/1997 |
| JP | 2000-000976 | 1/2000 |
| JP | 2006-159656 | 6/2006 |

* cited by examiner

*Primary Examiner* — Matthew Luu
*Assistant Examiner* — Renee I Wilson
(74) *Attorney, Agent, or Firm* — Fitzpatrick, Cella, Harper & Scinto

(57) ABSTRACT

The ink jet cartridge includes a tank case that has a space having a opening, a lid that closes the opening, an ink accommodating section that is formed with the space of the tank case and the lid, and an ink absorber that is accommodated in the ink accommodating section. Also, an atmosphere communication port that passes through the lid and a projection section that projects to the space of the tank case are provided in the lid. The ink absorber consists of a fiber aggregate, and a welding section in which the fibers are combined to each other and an unwelded section in which the fibers are not combined to each other are provided on a surface that faces the lid.

8 Claims, 8 Drawing Sheets

INK JET CARTRIDGE AND MANUFACTURING METHOD OF INK JET CARTRIDGE

BACKGROUND OF THE INVENTION

1. Field of the Invention

The present invention relates to an ink jet cartridge and a manufacturing method of the ink jet cartridge in which a fiber absorber is accommodated, wherein the fiber absorber is configured of a fiber aggregate in which a crossing point is unwelded, specifically, to the ink jet cartridge and the manufacturing method of the ink jet cartridge that improves a disadvantage or the like of the ink charging operation.

2. Description of the Related Art

An ink jet recording apparatus includes an ink jet recording head in which ink is discharged and an image is drawn, and an ink tank that accumulates ink that is supplied to the recording head. An ink tank is known in which an ink absorber is accommodated as a configuration of retaining ink. As the ink absorber, a fiber absorber that is formed of fiber aggregate or foam, such as urethane sponge is present. As one example of the fiber absorber, a felt fiber absorber is disclosed in Japanese Patent Application Laid-Open No. H06-255121. The felt fiber absorber is easy to adjust for appropriate fiber diameter, fiber length, arrangement direction or the like, and easy to adjust for storage ability of ink or supply ability of ink. Also, a material that is chemically stable with respect to ink can be selected.

As described above, the fiber absorber shows a high ability as the ink absorber, however destruction may be generated by external stress even though freedom of shape is present since the shape of the fiber absorber is determined by tangling of the fiber. Thus, there is a case whereby, for example, an air layer is generated at a connection section that is connected to an ink supply tube that is connected to an ink flow path, an adjustment of the density fails, and then the retention ability of ink or the supply ability of ink is affected. Further, in the fiber absorber, since many fiber ends become fluffy and project from the surface of the absorber, it is necessary to improve workability when the fiber absorber is filled within the ink tank and a lid covers the ink tank.

In Japanese Patent Application Laid-Open No. H07-047688, a technique is suggested, in which a change in the external shape is suppressed and lowering of the retention ability of ink or the supply ability of ink is suppressed by melting the surface of the fiber absorber.

Also, as a configuration of fiber aggregate, Japanese Patent Application Laid-Open No. H09-183236 discloses fiber of a core-clad structure in which polypropylene is arranged at a core section and polyethylene is arranged at a clad section. In the related art, a technique is disclosed in which only polyethylene is melted, and the crossing point of the fiber is welded using the difference between the melting points of the materials in the fiber aggregate so that shape maintenance and stiffness of the ink absorber are maintained. Further, a configuration is also disclosed in which the periphery of the fiber aggregate is thermoformed by heating and then an ink absorber is obtained which is suitable for the interior shape of the case of an ink tank.

As described above, an example an ink filling method with respect to the ink tank in which the fiber absorber of which the surface is melted is accommodated is disclosed in Japanese Patent Application Laid-Open No. 2000-000976. According to Japanese Patent Application Laid-Open No. 2000-000976, a technique is described in which ink is filled from the ink supply opening that is provided in the ink tank so as to supply ink to the ink jet recording head.

Meanwhile, an ink jet cartridge is disclosed in which the ink jet recording head and the ink tank are integrally configured. In the case of the ink jet cartridge, the ink jet recording head is already connected to the ink supply opening that is provided in the ink tank and when the method that is disclosed in Japanese Patent Application Laid-Open No. 2000-000976 is applied, ink is filled from an ink discharging port that is provided in the ink jet recording head. However, the ink discharging port of the ink jet recording head employs a configuration for discharging very small ink droplets and for example, the ink discharging port only has a diameter on the order of microns. Time is wasted on an operation where ink is charged from a very small port and adoption is difficult from the point of view of productivity. Also, when putting in to practice charging ink from the ink jet recording head side, there are many items to be considered.

While, Japanese Patent Application Laid-Open No. 2006-159656 discloses an example of a method of filling ink to the ink jet cartridge. In the publication, a fiber absorber is filled with respect to a case that has an opening in a surface opposite to the surface on which the ink jet recording head is arranged and a lid is welded over the opening so that the ink jet cartridge is manufactured. A configuration is disclosed in which an ink injection needle is inserted into an ink absorber from the opening and ink is injected before the lid is welded.

In the ink filling method that is disclosed in Japanese Patent Application Laid-Open No. 2006-159656, when the ink injection needle is pulled out from the ink absorber after ink is filled, friction force is generated between the ink absorber and the ink injection needle. In a case where the configuration is applied in points where the fibers cross each other in the fiber aggregate are not melted as disclosed in Japanese Patent Application Laid-Open No. H06-255121, as an example configuration of the fiber absorber, the ink absorber is dragged by the ink injection needle. Thus the ink absorber may move toward the ink injection port side, in other words, in a direction opposite to the ink supply section (ink supply opening side), and the contact between the ink absorber and the ink supply opening may be weakened and the ink supply may be unstable.

SUMMARY OF THE INVENTION

An advantage of some aspects of the invention is to provide an ink jet cartridge and a manufacturing method of an ink jet cartridge in which deformation or moving of an ink absorber (fiber absorber) may be suppressed or prevented within a case, which is configured by an ink tank, in an ink filling operation (pulling out operation of an ink injection needle) to an ink jet cartridge that includes the ink tank using the fiber absorber in which a crossing point between fibers is not welded.

Also, an advantage of some aspects of the invention is to provide an ink jet cartridge and manufacturing method of the ink jet cartridge where a configuration is employed in which ink can be filled with high speed.

According to an aspect of the invention, there is provided an ink jet cartridge including: an ink discharge device that discharges ink; an ink tank section that accumulates ink to supply ink to the ink discharge device; and an absorber in which a fiber, accumulating ink and being accommodated by capillary force in the ink tank section is aggregated and a crossing point of the fiber is in unwelded state; and wherein the fiber aggregate that faces with one surface oppose to arrangement surface of the ink discharge device of the ink tank section is melted/fused with at least two or more unmelted sections remained.

According to another aspect of the invention, there is provided a manufacturing method of an ink jet cartridge that integrally includes an ink discharge device that discharges ink, and an ink tank section that accumulates ink to supply ink to the ink discharge device, the method including: accommodating a fiber absorber in which a crossing point of the fiber is in unwelded state to the ink tank section; melting the fiber absorber that faces with one surface oppose to arrangement surface of the ink discharge device of the ink tank section so that at least two or more unmelted section remains; and filling ink by pricking an ink filling needle from an unmelted section.

According to the invention, a plurality of unmelted sections is included with respect to the surface of the fiber absorber that faces the opening of the case of the ink tank using the fiber absorber of which the crossing point between fibers is not welded, and the fiber absorber is melted so that the unmelted section is used as the insertion position of the ink injection needle. Since the position of the fiber absorber is maintained within the case by the melting surface with respect to the tank case, the deformation or moving of the ink absorber (fiber absorber) can be suppressed or prevented within the case, which is configured by the ink tank, in the charging operation (pulling out operation of the ink injection needle) of ink.

Since a plurality of unmelted sections is included, functions may be separated to a portion in which the ink needle is pricked and ink is charged, and a portion in which air escapes when ink is charged so that the ink charging speed can be increased.

Further, in a case where the opening position of the atmosphere communication port that is provided on the lid that is attached with respect to the case of the ink tank and the position of the unmelted section of the fiber absorber coincide with each other, the charging operation of ink is performed after the lid is welded on the case opening so that any concerns about overflow of ink or the like can be decreased.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1:
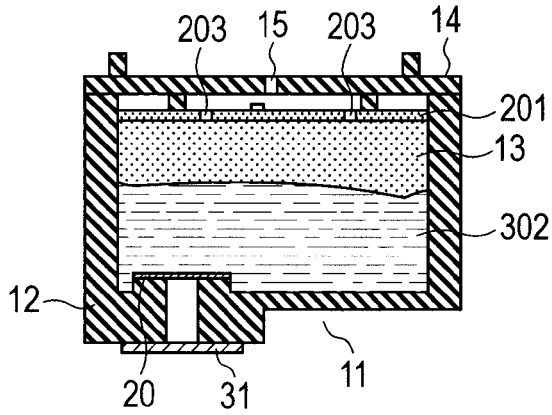
FIG. 1 is a cross-sectional view illustrating a first embodiment of an ink jet cartridge according to the invention.

FIG. 1 is a cross-sectional view illustrating a first embodiment of an ink jet cartridge 11 according to the invention.

The ink jet cartridge 11 integrally configures of an ink tank that includes a tank case 12 and a lid 14, and ink discharge device (a recording head) 31.

An ink absorber 13 is accommodated within the tank case 12. The ink 302 is charged in the ink absorber 13. The ink 302 is supplied to the recording head 31 through a filter 20. The supplied ink 302 is discharged from the recording head 31 according to a discharge signal.

The ink absorber 13 is a fiber aggregate that is configured by a plurality of aggregated fibers. A plurality of fibers is the fiber aggregate (fiber absorber) in which a crossing point between the fibers is not bonded by welding to each other (hereinafter, referred to as "the ink absorber" for convenience).

A material of the fiber that configures the ink absorber 13 is appropriately selected considering ink-resistant liquid-contacting property (ink-resistant property). For example, polyolefin, polyester, acrylonitrile or the like may be used as the material of the fiber, however polyolefin that is highly stable chemically can selected. As the structure of the fiber material, a fiber with a two-layer structure that includes a core-clad structure disclosed in Japanese Patent Application Laid-Open No. H09-183236 may be selected. Specifically, polypropylene (PP) and polyethylene (PE) may be selected for the core section and the clad section respectively.

Also, the ink absorber that is used in the embodiment may be fiber having a single material and using a single fiber of polypropylene since the crossing point between the fibers is not needed to bond by welding.

The ink absorber 13 is needed to accommodate within the tank case 12 so as to set a negative pressure that is appropriate to the ink jet cartridge 11.

The negative pressure of the ink tank is determined by the dimensions of the void present within the ink absorber 13. In other words, an average negative pressure may be decided by the ratio (hereinafter, referred to as "fiber density") of the ink absorber volume that is formed in the tank case 12 and the fiber weight that is present in the ink absorption section, and a diameter of the fiber. The fiber density may be appropriately selected by the negative pressure that is obtained in the ink jet cartridge and the average fiber density is 12% in the embodiment.

The negative pressure may be adjusted even a case that the fiber diameter is appropriately selected. 6.7 d tex is selected in the embodiment.

Since a length of the fiber is not an element affecting the negative pressure characteristic, the length of the fiber may be appropriately selected according to handling in the manufacturing and may be appropriately selected if the length is equal to or longer than the length of the fibers that are entangled to each other. As a result of review, in the embodiment, the length is needed to be equal to or more than 6 mm that is considered as maintaining shape by the entanglement of the fibers to each other and specifically, the length of the fiber of 50 mm is used from the point of view of shape maintenance after the shaping of the ink absorption body or the entanglement property of the fibers to each other.

Figure 2A:
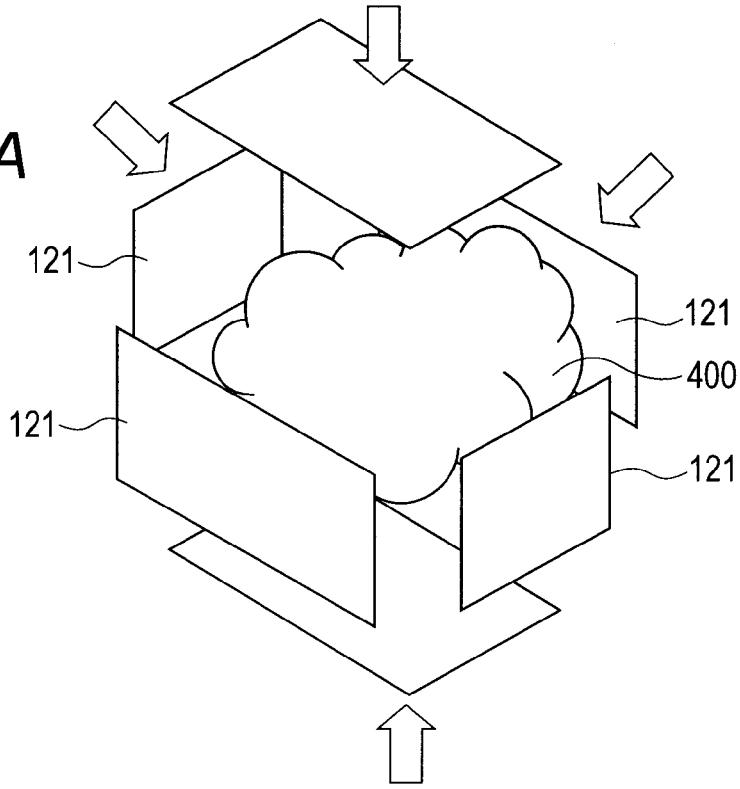
FIGS. 2A and 2B are diagrams schematically illustrating a process until an ink absorber is inserted into the ink jet cartridge.
Figure 2B:
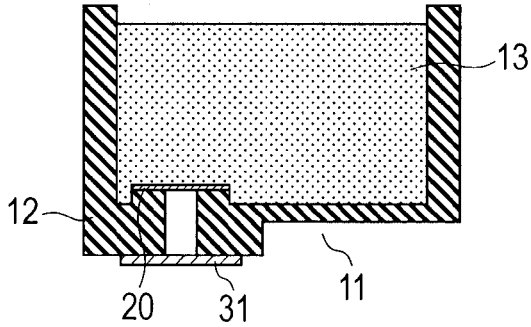

FIGS. 2A and 2B are diagrams schematically illustrating a fiber body 400 that combines fibers having the above-described conditions, wherein the fiber body 400 is machined by compression to a preferred dimension shape and inserted within the tank case 12.

FIG. 2A illustrates the shape of the fiber body 400 that is compressed by a compression plate 121 and temporarily formed with a preferred dimension. As above described, the ink absorber 13 which is temporarily formed is inserted within the tank case 12 from the opening of the tank case 12 that is provided at a side surface opposite to a side surface on which a recording head 31 is attached and enters a state as shown in FIG. 2B.

Figure 3:
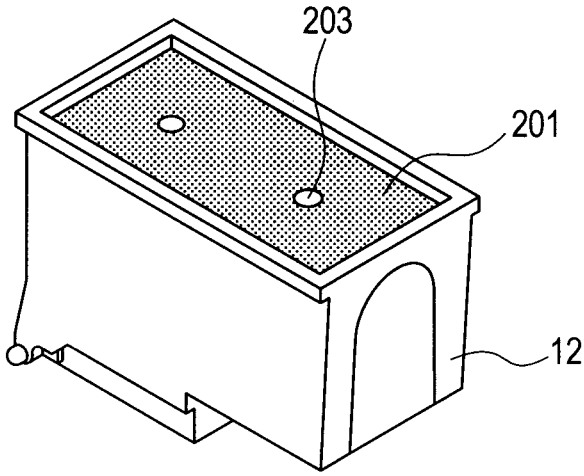
FIG. 3 is a perspective view schematically illustrating the first embodiment of the ink jet cartridge according to the invention.

Next, one surface of the ink absorber 13 that faces the opening of the tank case 12 is melted by heating, as using a heating tool (referred to as "a heating jig") jig (not shown). As shown in FIG. 3, the melting by heating is performed such that a welding section 201 is formed that has a plurality of unwelded sections 203 with respect to one surface of the ink absorber. In the embodiment, the unmelted section 203 forms a non-contact section that does not contact the ink absorber 13 with respect to a contact surface with the ink absorber 13 of the heating jig that forms the melting section 201 and thereby the unwelded section 203 is manufactured.

Thus, the temperature of the contact surface of the heating jig is set higher than the melting point of the ink absorber and the heating jig and the ink absorber are contacted to each other so that the fiber of the ink absorber that contacts the contact surface is melted, combined the fibers to each other and a welding section is formed. An unwelded section of the ink absorber in which the fibers are not combined to each other at a position in which the non-contact section is arranged is formed. Conditions of the melting by heating are different from the fiber materials, however the fiber is melted by heating to a temperature higher by about 5 to 20° C. than the melting point of the fiber material and the melting section 201 may be formed.

Also, the forming method of the unwelded section 203 is not limited to the above description, and once the welding section 201 is entirely formed with respect to one surface of the ink absorber 13 that faces the opening of the tank case 12 and additional machining, such as cutting machining, is performed so that the unwelded section 203 may also be formed. The order of forming the welding section 201 and the unwelded section 203 is not set and may be performed before the ink absorber 13 is inserted into the tank case 12, or as described above, may be performed afterwards.

When the welding section 201 is formed on the surface of the ink absorber (the fiber aggregate) 13, the fibers are not only tangled to each other but also the fibers are welded and combined such that the surface is difficult to deform, and deformation of the external shape of the ink absorber 13 can be suppressed. Thus, even though external stress, such as vibration or falling impact, is added to the ink absorber 13 during distribution, the ink absorber 13 is difficult to deform, weakening of the contact to the filter 20 of ink supply section 7 can be prevented and lowering of ink maintenance ability or ink supply ability can be suppressed.

Additionally, as described below, even in a case where the ink injection needle pricks the ink absorber and the ink is charged, when the ink injection needle that was pricked is pulled out, the ink absorber may be suppressed from deviating.

Also, by providing the unwelded section 203, the ink injection needle 301 is inserted into the ink absorber from the unwelded section 203 and the ink 302 can be injected, however when a plurality of the unwelded sections 203 are provided, the ink injection needle 301 is inserted into the ink absorber 13 from a plurality of the unwelded section 203 and the ink 302 can be injected so that the ink injection time can be reduced.

FIGS. 4A to 4D are cross-sectional views schematically illustrating a series of manufacturing processes that configure the ink jet cartridge in which ink is charged and the lid is attached, after the unwelded section 203 remains and the welding section 201 is formed.

Figure 4A:
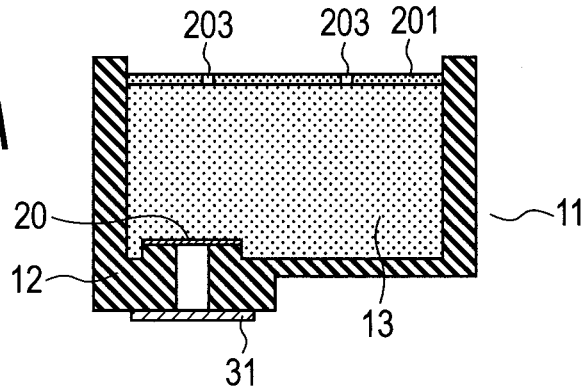
FIGS. 4A, 4B, 4C and 4D are cross-sectional views illustrating a portion of a manufacturing process of the ink jet cartridge of the first embodiment of the ink jet cartridge according to the invention.
Figure 4B:
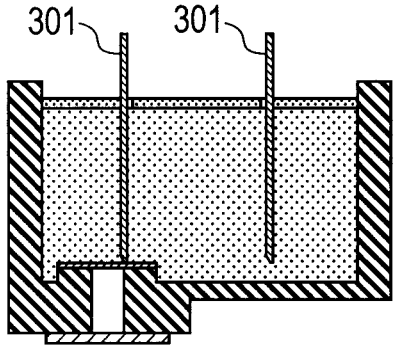
Figure 4C:
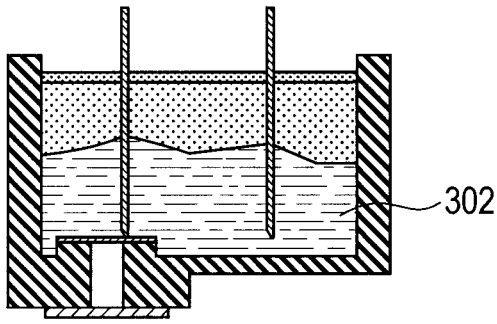
Figure 4D:
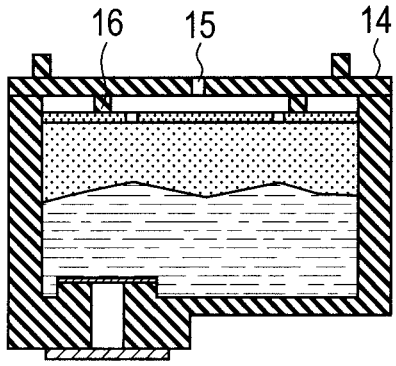

The melting section 201 in which a plurality of the unmelted sections 203 is present is formed in the ink absorber 13 that is inserted into the tank case 12 (see FIG. 4A). As shown in FIG. 4B, a plurality of the ink injection needles 301 is inserted within of the tank case 12 through the unmelted section 203. In the embodiment, two ink injection needles 301 are pricked with respect to each of two unwelded sections 203. Subsequently, as shown in FIG. 4C, ink is charged into the absorber from the inserted ink injection needle 301. After the charge of ink is completed, as shown in FIG. 4D, the needle is removed and the lid 14 in which an atmosphere communication port 15 is formed is bonded to the tank case 12 and the ink jet cartridge is completed.

Also, the number and position of the ink injection needles, in other words, the number and position of the unmelted sections, manufacturing costs or ink charge distribution within the ink tank are taken into consideration and then are appropriately changed.

Figure 5A:
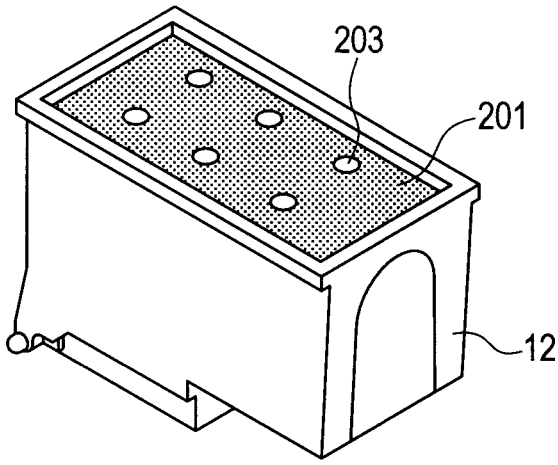
FIGS. 5A and 5B are perspective views schematically illustrating a variation of the ink jet cartridge according to the invention.
Figure 5B:
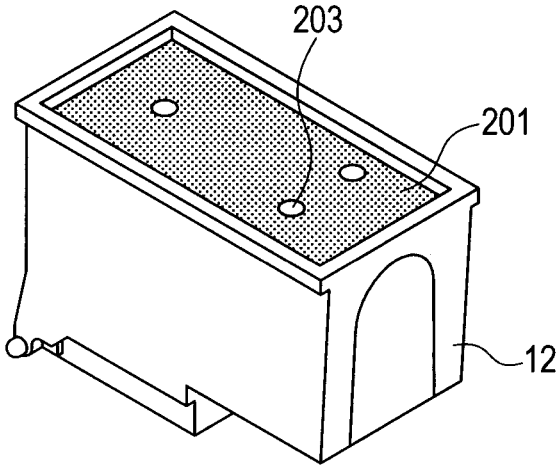

For example, as shown in FIG. 5A, the number of the unwelded sections 203 may also be increased so as to increase the number of the injection needles. As shown in FIG. 5B, more of the ink injection needles are arranged in a specific portion and the arrangement balance of the unmelted sections may also be adjusted so as to operate the ink charge distribution.

A rib 16 is provided within the lid 14. The rib 16 is a positional relationship that does not contact the unwelded section 203 in a state where the lid 14 is bonded to the tank case 12. As the arrangement relationship is accomplished, when ink moves to the proximity of the unmelted section, ink moves to the atmosphere communication port through the rib and leakage to the outside can be prevented. As shown in FIG. 1 (FIG. 4D), in the embodiment, the rib 16 that is provided in the lid 14 is arranged outside of each of the unwelded sections 203 in which two ribs 16 are provided, and a total of two ribs 16 are included.

Figure 6A:
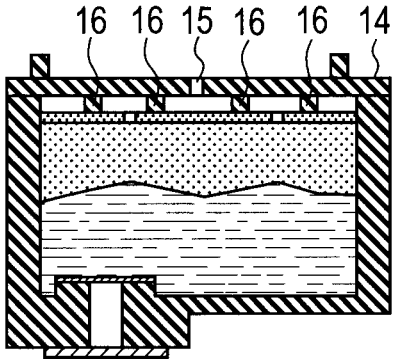
FIGS. 6A and 6B are views schematically illustrating a variation of the ink jet cartridge according to the invention.
Figure 6B:
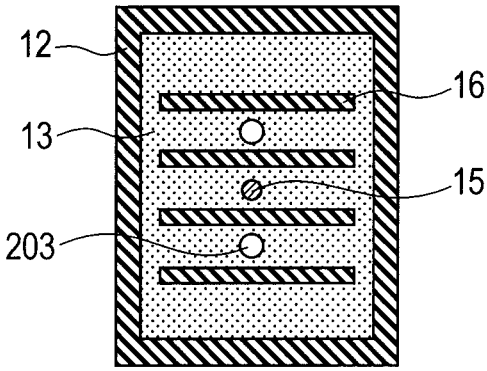

The number of ribs of the lid can be appropriately set. For example, as shown in FIGS. 6A and 6B, a further two ribs are added with respect to the arrangement configuration of ribs shown in FIG. 1. The added ribs are arranged so as to obstruct the unwelded sections 203 that are provided in two and the atmosphere communication port 15 that is provided in the lid.

The rib 16 is arranged in such a manner, the leakage of ink to the outside can prevented without ink directly reaching the atmosphere communication port, even in a case where ink is squirted from the unmelted section during external stress, such as falling impact. Since atmosphere communication that is needed to supply ink to the ink-discharging device is performed between the unmelted section 203 and the atmosphere communication port 15, the rib 16 does not contact the interior wall of the tank case 12 and secures space that is needed for the atmosphere communication.

Second Embodiment

FIGS. 7A to 7E and FIG. 8 are cross-sectional views schematically illustrating a second embodiment of an ink jet cartridge 11 according to the invention.

The first embodiment discloses the configuration in which a plurality of unwelded sections is used as the ink injection section, however the embodiment discloses an example in which an unwelded section which is not used in the ink injection is present in a plurality of unmelted sections. FIGS. 7A to 7E are schematic views illustrating an outline of the manufacturing process of the ink cartridge of the embodiment. First, the melting section 201 having three unmelted sections 203 is formed with respect to one surface of the ink absorber 13 that faces the opening of the tank case 12 using the method described in the first embodiment (see FIGS. 7A and 7B).

Figure 7A:
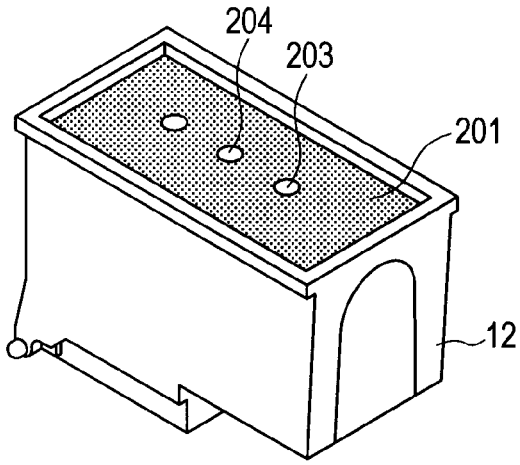
FIGS. 7A, 7B, 7C, 7D and 7E are cross-sectional views illustrating a portion of manufacturing process of the ink jet cartridge of the second embodiment of the ink jet cartridge according to the invention.
Figure 7B:
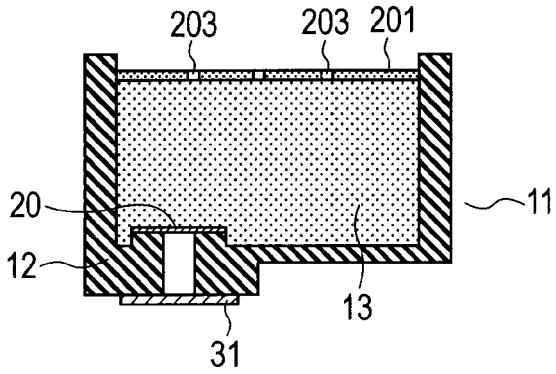
Figure 7C:
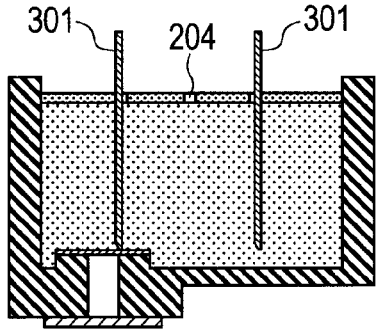
Figure 7D:
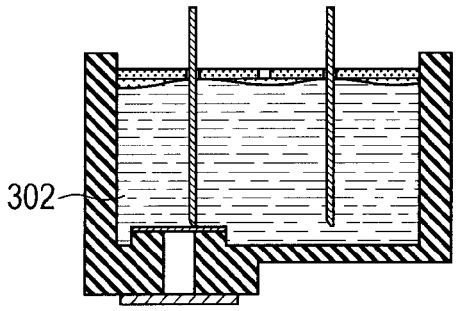

The ink injection needle 301 is inserted into the ink absorber using two unmelted sections 203 located in the end among the unmelted sections 203. At this time, one unmelted section 204 that is present in the central portion is not inserted into the ink injection needle (see FIG. 7C). In this state, as shown in FIG. 7D, ink is charged. The unmelted section 204 functions as an escape passage for air within the ink absorber when ink is charged.

Figure 7E:
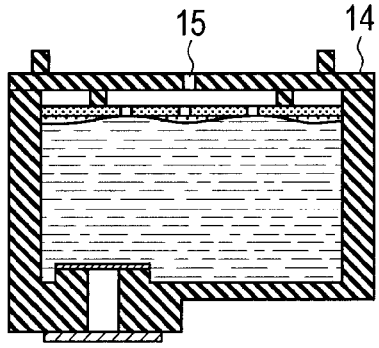

After ink charge is completed, the lid 14 is welded to the tank case so that the ink jet cartridge is completed (see FIG. 7E).

In the ink absorber, the surface of which has been melted by heating, the air escape passage that is present within the ink absorber is controlled when ink is injected. Thus, in a case where a large volume of ink is injected at high speed, displacement of air and ink is improperly timed and a closed space is formed by the injected ink, so that ink may not be charged effectively with respect to the absorber volume.

On the other hand, even in a case where ink having full volume of the ink tank is injected at high speed, through the operation of the unmelted section 204 that becomes an air escape hole, the absorber may be charged without a closed space being generated by the ink. As the result, the ink 302 can be further uniformly charged within the ink absorber 13.

The position of the unmelted section 204 that becomes the air escape hole is not limited to the above description and may be appropriately changed. Specifically, when the unmelted section 204 is provided in the vicinity of a portion to which ink is finally charged to the absorber during the ink charging process, the above-described effect is further exhibited.

Third Embodiment

Figure 8:
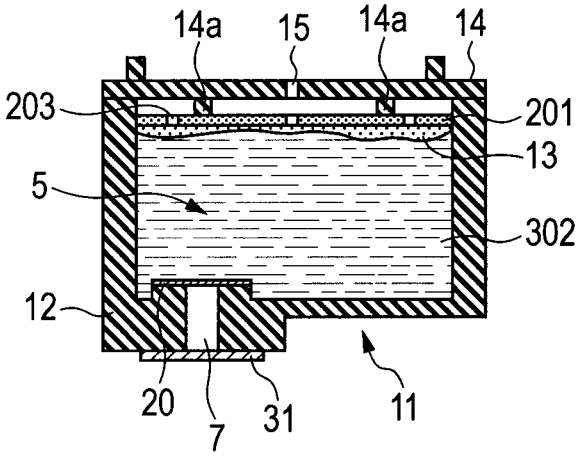
FIG. 8 is a cross-sectional view illustrating a third embodiment of an ink jet cartridge according to the invention.

FIG. 8 is a configuration view schematically illustrating a third embodiment of an ink jet cartridge according to the invention.

The ink jet cartridge 11 configures of the tank case 12 in which a space include an opening is provided, the lid 14 includes the atmosphere communication port 15 and the ink discharge device 31. An ink storage section 5 is formed between the space of the tank case 12 and the lid 14. A rib shaped projection section 14*a* is projected toward the ink storage section 5 in the lid 14 so as to be in pressing contact with the ink absorber 13. Also, an atmosphere communication port 15 is provided through the lid 14. An ink supply section 7 is provided through between the ink storage section 5 and the outside of the tank case 12, filter 20 is provided at the ink storage section 5 side of the ink supply section 7 and the ink discharge device 31 is provided on the outside. The ink absorber 13 is accommodated in the ink storage section 5 and the ink 302 that is charged to the ink absorber 13 is supplied to the ink discharge device 31 through the ink supply section 7.

Figure 9:
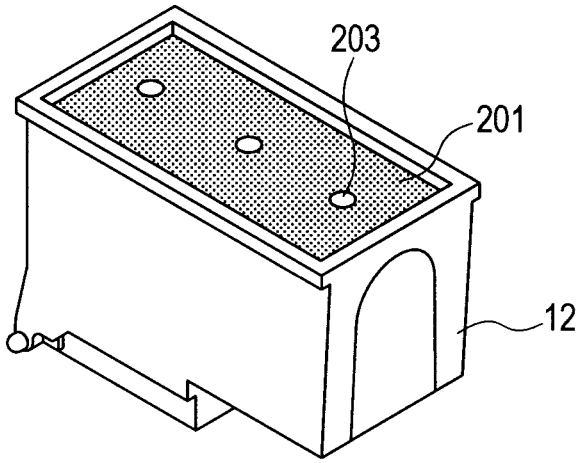
FIG. 9 is a perspective view schematically illustrating the third embodiment of the ink jet cartridge according to the invention.

The ink absorber 13 may use the fiber material that is described in the first embodiment. Thus, according to a method the same as the method of the first embodiment, a plurality of the unwelded sections 203 remains on the surface that faces the case opening of the ink absorber 13 and the unwelded section 203 is melted by heating and thereby the welding section 201 is formed (see FIG. 9). Also, one of the unwelded sections 203 is arranged on a position that is opposite to the atmosphere communication port 15 that is formed on the lid 14. The other unwelded sections 203 are arranged at positions other than those opposite to the atmosphere communication port 15.

Figure 10A:
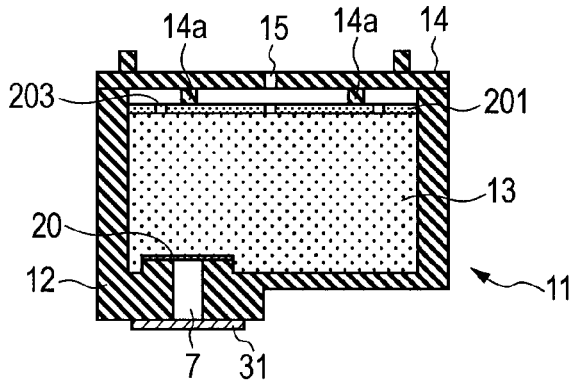
FIGS. 10A, 10B, 10C and 10D are cross-sectional views illustrating a portion of manufacturing process of the ink jet cartridge of the third embodiment of the ink jet cartridge according to the invention.

Thus, the lid 14 closes the opening of the tank case 12 and the tank case 12 and the lid 14 are melted together (see FIG. 10A). In this state, the unwelded section 203 that is formed in the ink absorber 13 is opposite to the atmosphere communication port 15 that is formed in the thank lid 14. Additionally, the projection section 14*a* is arranged on the lid 14 so that the projection section 14*a* contacts the welding section 201 and the ink absorber 13 is in pressing contact with the filter 20 by the projection section 14*a*. The unwelded section 203 and the projection section 14*a* have a positional relationship not contacting each other. Thus, the ink 302 is suppressed from moving to the atmosphere communication port 15 through the projection section 14*a*, even though the ink 302 moves to the vicinity of the unwelded section 203. As the result, the ink 302 is prevented from being leaked to the outside of the tank case 12.

Figure 10B:
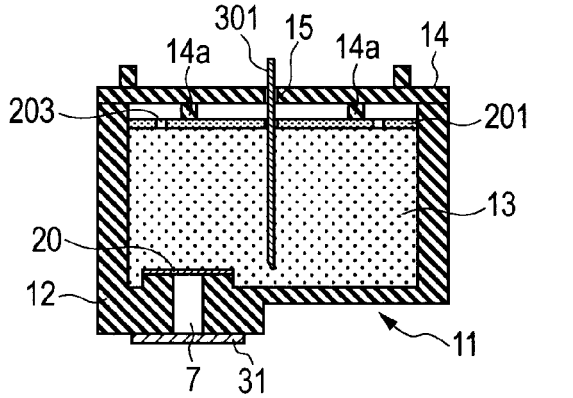

Next, the ink injection needle 301 for injecting the ink 302 is inserted into the ink absorber 13 within the ink storage section 5 through the atmosphere communication ports 15 and the unwelded section 203 from the outside of the ink jet cartridge 11 (see FIG. 10B).

Figure 10C:
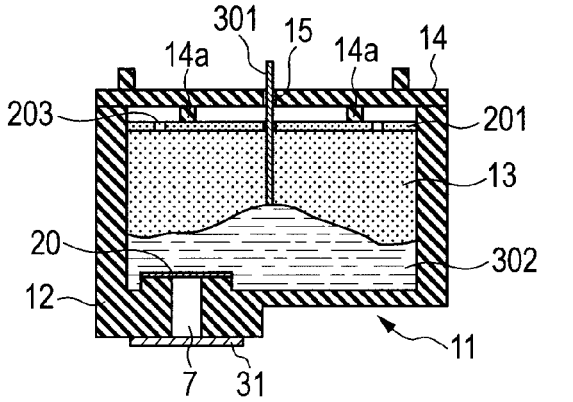
Figure 10D:
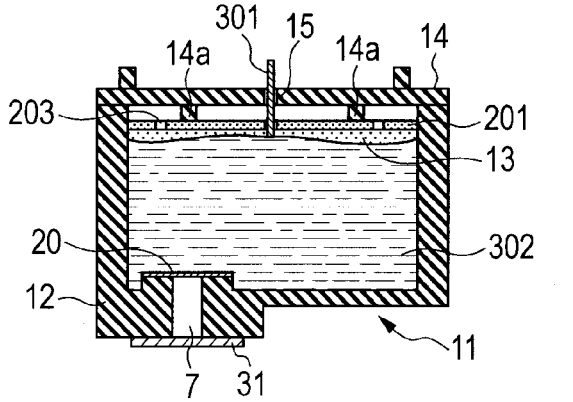

Subsequently, the ink 302 is charged into the ink absorber 13 through the ink injection needle 301 (see FIGS. 10C and 10D).

In case of the invention, when the ink injection needle 301 is pulled out from the ink absorber 13, weakening of the contact between the ink absorber 13 and the filter 20 of the ink supply section 7 can be prevented, wherein the weakening occurs due to deformation of movement of the ink absorber 13 that is caused by friction between the ink absorber 13 and the ink injection needle 301. Therefore, the melting section 201 is provided so that the ink absorber can be maintained in a stable position within the case. Also, that the ink absorber 13 is pressed and fixed by the rib shaped projection section 14*a* that is provided on the lid 14 is a preferable configuration to further stably prevent that the ink absorber 13 being deformed or moved to a side opposite to the ink supply section 7.

The number of the ink injection needles 301, the number and the position of the atmosphere communication ports 15, and the number and the position of the unwelded sections 203 may be changed appropriately as necessary.

As described above, the ink jet cartridge 11 of the invention can more easily perform ink supply into the ink storage section 5 when compared to the conventional ink jet cartridge. Also, the ink absorber 13 that maintains the ink 302 within the ink storage section 5 can be prevented from deforming or moving within the ink storage section 5.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-041734, filed Feb. 26, 2010, which is hereby incorporated by reference herein in its entirety.

What is claimed is:

1. An ink jet cartridge comprising:

an ink discharge device that discharges ink;

an ink tank section that accumulates ink to supply ink to the ink discharge device;

an absorber in which a fiber accumulating ink by capillary force and being accommodated in the ink tank section is aggregated and a crossing point of the fiber is in unwelded state; and a lid member bonded to one surface opposed to the arrangement surface of the ink discharge device of the ink tank section;

wherein the fiber aggregate that faces with one surface opposed to an arrangement surface of the ink discharge device of the ink tank section is melted/fused with an unmelted section remaining; and wherein the lid member is provided with a rib that is bonded to the ink absorber and the rib does not contact the unmelted section that is provided in the absorber.

2. The ink jet cartridge according to claim 1, wherein an atmosphere communication opening of the lid member and one unwelded section of the absorber are opposed to each other.

3. A manufacturing method of an ink jet cartridge that integrally includes an ink discharge device that discharges ink, and an ink tank section that accumulates ink to supply ink to the ink discharge device, the method comprising:

accommodating a fiber absorber in which a crossing point of the fiber is in unwelded state to the ink tank section;

melting the fiber absorber that faces with one surface opposed to an arrangement surface of the ink discharge device of the ink tank section so that an unmelted section remains;

bonding a lid member to one surface opposed to the arrangement surface of the ink discharge device of the ink tank section; and filling ink by pricking an ink filling needle from the unmelted section;

wherein the lid member is provided with a rib that is bonded to the ink absorber and the rib does not contact the unmelted section that is provided in the absorber.

4. The method according to claim 3, wherein the filling of ink is performed before the lid is bonded, and performed using a plurality of locations of the unmelted sections.

5. The method according to claim 3, wherein the filling of ink is performed after the lid is bonded, and performed by pricking an injection needle to the ink absorber through the atmosphere communication opening that is formed on the lid member and the unmelted section that is formed on upper surface of the ink absorber to inject ink.

6. The method according to claim 3, wherein a temperature of at least the contact surface of a heating tool having a contact surface in which the non-contact section is provided is set higher than the melting point of the ink absorber, the heating tool and the ink absorber are contacted to each other, the fiber of the ink absorber that contacts the contact surface is melted and the fibers are bonded to each other so that the welding section is formed and the unwelded section in which the fibers are not bonded to each other is formed at a position of the ink absorber in which the non-contact section is arranged.

7. The inkjet cartridge according to claim 1, wherein at least two or more unmelted sections remain.

8. The method according to claim 3, wherein at least two or more unmelted sections remain.

* * * * *